US012037092B2

(12) United States Patent
Boo et al.

(10) Patent No.: US 12,037,092 B2
(45) Date of Patent: Jul. 16, 2024

(54) FLOATING OFFSHORE FOUNDATION INCLUDING MODULAR COMPONENTS, METHOD FOR MODULAR ASSEMBLY OF THE FLOATING OFFSHORE FOUNDATION, AND A RECONFIGURABLE SYSTEM FOR THE FLOATING OFFSHORE FOUNDATION

(71) Applicant: VL Offshore, LLC, Houston, TX (US)

(72) Inventors: Sung Youn Boo, Houston, TX (US); Steffen A Shelley, Houston, TX (US)

(73) Assignee: VL Offshore, LLC, Houston, TX (US)

( * ) Notice: Subject to any disclaimer, the term of this patent is extended or adjusted under 35 U.S.C. 154(b) by 17 days.

(21) Appl. No.: 18/128,413

(22) Filed: Mar. 30, 2023

(65) Prior Publication Data

US 2023/0257082 A1 Aug. 17, 2023

Related U.S. Application Data

(63) Continuation of application No. PCT/US2023/012960, filed on Feb. 13, 2023.

(60) Provisional application No. 63/309,544, filed on Feb. 12, 2022.

(51) Int. Cl.

| | |
|---|---|
| ***B63B 73/10*** | (2020.01) |
| ***B63B 1/12*** | (2006.01) |
| ***B63B 35/38*** | (2006.01) |
| *B63B 35/44* | (2006.01) |

(52) U.S. Cl.

CPC ..... *B63B 73/10* (2020.01); *B63B 1/125* (2013.01); *B63B 35/38* (2013.01); *B63B 2035/446* (2013.01)

(58) Field of Classification Search

CPC ..... B63B 73/10; B63B 1/125; B63B 35/38; B63B 2035/446

See application file for complete search history.

(56) References Cited

U.S. PATENT DOCUMENTS

| | | | | |
|---|---|---|---|---|
| 7,891,909 | B2 | 2/2011 | Tahar et al. | |
| 8,757,082 | B2 | 6/2014 | Rijken et al. | |
| 8,807,062 | B2 | 8/2014 | Tahar et al. | |
| 10,634,122 | B1 * | 4/2020 | Clifton | E04H 12/345 |
| 2008/0190346 | A1 | 8/2008 | Krehbiel et al. | |
| 2011/0155038 | A1 * | 6/2011 | Jahnig | F03D 13/25 114/264 |
| 2016/0369780 | A1 * | 12/2016 | Aubault | F03D 13/25 |
| 2018/0030963 | A1 * | 2/2018 | Viselli | B63B 35/003 |
| 2018/0105235 | A1 * | 4/2018 | Zou | B63B 35/44 |
| 2020/0062351 | A1 | 2/2020 | Le Gleau et al. | |
| 2020/0269960 | A1 | 8/2020 | Boo et al. | |

(Continued)

FOREIGN PATENT DOCUMENTS

| | | | |
|---|---|---|---|
| DK | 201670747 | A1 | 4/2017 |
| EP | 2576916 | B1 | 4/2017 |

(Continued)

*Primary Examiner* — S. Joseph Morano
*Assistant Examiner* — Jovon E Hayes
(74) *Attorney, Agent, or Firm* — Bridgeway IP Law Group, PLLC; Hyun Woo Shin; Sang Ho Lee

(57) ABSTRACT

A floating foundation includes a plurality of unit modules that can be fabricated in an efficient manner and then assembled, on shore or afloat near the deployment location. The floating foundation can be applied to various offshore energy systems, such as wind power generation, and in deployment locations with limited infrastructure.

22 Claims, 16 Drawing Sheets

(56) References Cited

U.S. PATENT DOCUMENTS

| | | | | |
|---|---|---|---|---|
| 2020/0307745 | A1 | 10/2020 | Aguire et al. | |
| 2020/0392946 | A1* | 12/2020 | Wong | B63B 35/44 |
| 2022/0332395 | A1* | 10/2022 | Sønju | B63B 35/44 |

FOREIGN PATENT DOCUMENTS

| | | | |
|---|---|---|---|
| FR | 3064973 | A1 | 10/2018 |
| WO | 2020169158 | A1 | 8/2020 |
| WO | 2021/148156 | A1 | 7/2021 |

* cited by examiner

FLOATING OFFSHORE FOUNDATION INCLUDING MODULAR COMPONENTS, METHOD FOR MODULAR ASSEMBLY OF THE FLOATING OFFSHORE FOUNDATION, AND A RECONFIGURABLE SYSTEM FOR THE FLOATING OFFSHORE FOUNDATION

CROSS-REFERENCE TO RELATED APPLICATION

This application is a continuation of international application No. PCT/US2023/012960, filed on Feb. 13, 2023, which claims priority to U.S. provisional application No. 63/309,544, filed on Feb. 12, 2022, the disclosures of which are hereby incorporated by references in their entirety.

TECHNICAL FIELD

The present disclosure relates to a marine structure, and more particularly, to offshore semi-submersible (Semi) and vertically moored type platforms (Tension Leg Platform, TLP) for supporting a wind power generation system. The present disclosure also relates to and is applicable to a floating structure supporting a variety of other equipment and systems, including power substation, oil and gas processing and production, and renewable energy and resource utilization, deployed in a marine or aquatic environment.

BACKGROUND

Wind turbines, both horizontal axis and vertical axis types are used to generate electrical power by transforming wind kinetic energy into electrical energy. To date, the majority of wind turbines used to produce energy offshore have been installed in shallow, coastal waters on fixed foundations of single towers (mono-piles), gravity bases or lattice structures (jackets) to a water depth of around 40 meters. However, at greater water depths, fixed foundations become economically or technically infeasible. Therefore, using floating foundations for offshore wind is required as the offshore wind power generating industry moves further offshore and into deeper water. The advantages of using floating foundations for wind power further offshore are that (1) more power can be generated due to the more steady and higher velocity winds that are observed further offshore; (2) locating wind turbines further offshore reduces or eliminates sight-line issues from shore; and (3) locating wind turbines further offshore reduces or eliminates impacts on coastal recreational areas or fisheries.

Current floating wind foundation technology include four types: semi-submersible (Semi), spar, tension leg platform (TLP) and barge. FIG. 1 shows a conventional Semi or TLP floating platform, which includes a central buoyant column and three outer buoyant columns coupled to each other via tubular and structural shape systems.

Conventional and existing floating foundations are often uneconomical due to their method of fabrication and assembly and design shortcomings that limit their scalability. Conventional floating wind foundations are assembled at one fabrication facility from pieces or components such as stiffened panels, tubular structures or combined. This conventional method of fabricating large foundations often utilizes all available fabrication facility resources including fabrication space. This complete utilization of fabrication resources precludes efficient serial production of conventional floating foundations and limits fabrication facility capacity for other projects, hence driving up the cost of fabrication for the conventional floating offshore foundation. In some cases, the fabrication of large conventional foundations may not be feasible in existing fabrication facilities because of platform characteristics such as size and quayside draft. For example, the span of a conventional floating foundation to support a 15 MW horizontal turbine is approximately 100 m or more, requiring up to 10,000 square meters of fabrication facility space for one unit. The quayside space length for loadout of a large conventional turbine will also be 100 m or longer.

Many offshore areas with good wind resources offshore lack nearby facilities available to fabricate any conventional floating foundation. Thus, large conventional foundations are also excluded from fabrication in areas with limited fabrication facilities and supporting infrastructure or are otherwise subject to additional execution risks and costs which greatly increase their deployment cost. Therefore, the fabrication of large conventional foundations is often economically ineffective in such regions. Additional execution costs and risks arise from fabricating the large conventional floating foundations overseas or other regions and then transporting them to and offloading them at the local deployment site. Alternatively, additional execution costs can arise through large capital expenditures required to upgrade the existing local facilities and infrastructure to allow for the fabrication and deployment of the large conventional floating foundations. In the United States, offshore California and Hawaii are two examples of areas with limited infrastructure to support the fabrication and deployment of large floating wind foundations.

Therefore, what is clearly needed is an innovative floating foundation design solution that is less expensive to build using locally and regionally available infrastructure so that floating offshore wind projects will be economically viable and have lower risk in areas like offshore California.

The examples used herein relate to the application of the floating foundation of the present disclosure for supporting wind turbines. However, the present disclosure can have a variety of applications for different uses and functions (e.g., conventional oil and gas or other renewable energy and ocean resource production equipment and systems, such as floating offshore power substation or energy storage systems).

SUMMARY OF THE DISCLOSURE

In an embodiment of the disclosure, a multi-column stabilized unit for a floating offshore foundation includes a plurality of modules of outer pontoons, a central pontoon, nodes, outer columns, support truss and an interface node. The floating foundation supports offshore energy production systems, including floating offshore wind using horizontal axis turbines (HAWT) or vertical axis turbines (VAWT). In general, when the floating foundation is combined or integrated with a wind turbine or other equipment and systems, the combined or integrated unit is referred to as a platform. Once the platform is connected to mooring at an operating site, the unit is referred to as an installed platform. However, the terms "foundation" and "platform" may be used interchangeably throughout the present disclosure unless otherwise specified in context.

The floating foundation can also be used to support conventional oil and gas or other renewable and ocean resource production equipment and systems such as floating offshore power substations or energy storage systems. The floating foundation includes a plurality of modules that are uniquely arranged to provide hydrostatic and hydrodynamic support to the energy production system.

The outer columns include a plurality of columns that may have uniform or varying heights and diameters or section widths. The outer columns may also be separable and detachable in whole or in part from the node which connects and supports them on the foundation. Parts of the outer column modules may be reconfigured in response to the power production system being changed on the foundation, changes in the installed platform's hydrodynamic and hydrostatic operating requirements, or the platform being redeployed to another operating site.

The nodes are connected to the outer pontoons which are connected around a central pontoon. The outer pontoons also support the trusses that connects the outer pontoons to an interface node. The energy production system, such as a wind turbine, is connected to the interface node.

Embodiments of the disclosure allows for modules to be fabricated and assembled in an efficient manner. Assembly of the modules to form the floating foundation can be completed on land, afloat, or on watercraft (vessels, barges and floating docks), using local infrastructure and support vessels.

The modules can be fabricated from steel, concrete, synthetic polymer foam (or any other suitable polymer material) or any combination of such materials.

Modules may also have an endo-structural system (ESS) including a plurality of structural elements around which the module is formed or constructed. The ends of the ESS protrude from the modules and are used to connect to other modules.

The modules may be assembled using welding, bolting or grouting. Grout may include cement based or synthetic binding materials.

The modules may be assembled by pinned, flanged or receptacles and tab locking connections.

The modules may be assembled by inserting extensions of one module into receptacles of another module. This may be done laterally, horizontally or vertically.

The modules may also be assembled using chains and chain connectors, including links.

Modules may also be assembled using mechanical pin and receptable connectors.

Modules may also be connected using ultra-high-performance concrete (UHPC) combining with internal pre-tensioned wires.

The modules may be assembled by any combination of the methods noted above.

Module connections interface surfaces may also be direct contact or soft contact with a polymer material used between the modules' surfaces.

In one aspect of the present disclosure, a floating offshore foundation includes a plurality of unit modules capable of being connected to each other, the floating offshore foundation including: a central pontoon module; a plurality of outer pontoon modules configured to have one end thereof connected to the central pontoon module; a plurality of outer node modules, each of the outer node module configured to connect to an other end of a corresponding outer pontoon module of the plurality of outer pontoon modules; a support truss module disposed above the central pontoon module and including a plurality of legs, each of the plurality of legs configured to connect to an upper side of a corresponding outer pontoon module; and a plurality of outer column modules, wherein each of the plurality of outer column modules are reconfigurable and are disposed on an upper side of a corresponding outer node module of the plurality of outer node modules, and wherein the plurality of unit modules are configured to connect to each other.

In another embodiment, each of the outer column modules includes a plurality of columns.

In another embodiment, each of the plurality of the columns includes a plurality of column sub-modules, and the each of the plurality of the column sub-modules are configured to connect to and disconnect from each other.

In another embodiment, at least one of the plurality of column sub-modules has a different shape or dimension or is made of a different material.

In another embodiment, at least one of the plurality of the column sub-modules includes a central connector for fixing the plurality of the column sub-modules.

In another embodiment, the plurality of unit modules are configured to connect to each other by a mechanical means.

In another embodiment, the mechanical means for connecting the plurality of unit modules is one or more means selected from the group consisting of stabbing structures with locking pins, structural plates/tubulars, flanges, arrayed interlocking joints, receptacles and tab locking structures, ultra-high performance concrete, pin and hinge connection, and pin and box connection.

In another embodiment, the floating offshore foundation further includes an internal endo-structural system connecting the plurality of outer pontoon modules to the central pontoon module, the outer pontoon modules to the outer node modules, and/or the support truss module to the outer pontoon modules.

In another embodiment, the internal endo-structural system includes a plurality of structural members disposed within the unit modules.

In another embodiment, the structural members of the internal endo-structural system protrude from a male unit module which connect to a respective female unit module.

In another embodiment, the structural members are made of steel and a surrounding material is made of a material lighter than steel.

In another embodiment, the floating offshore foundation further includes an interface node module configured to support an offshore energy system there above and to connect to an upper side of the support truss module.

In another embodiment, wherein the interface node module includes a structural component for connecting to the support truss module and a connection component configured to support the offshore energy system, wherein the connection component is replaceable to accommodate different types and sizes of offshore energy systems.

In another embodiment, the legs of the support truss module are connected to the corresponding outer pontoon module at a connection angle between 45 and 60 degrees.

In another embodiment, an end of the legs of the support truss module are connected via a hinge and pin connection component disposed on the upper side of the outer pontoon modules.

In another aspect of the present disclosure, a method of assembling a modular floating offshore foundation includes: manufacturing a plurality of unit modules of the modular floating offshore foundation; and connecting the plurality of units modules, wherein the plurality of unit modules includes: a central pontoon module; a plurality of outer pontoon modules configured to have one end thereof connected to the central pontoon module; a plurality of outer node modules, each of the outer node module configured to connect to an other end of a corresponding outer pontoon module of the plurality of outer pontoon modules; a support truss module disposed above the central pontoon module and including a plurality of legs, each of the plurality of legs configured to connect to an upper side of a corresponding outer pontoon module; and a plurality of outer column modules, wherein each of the plurality of outer column modules are reconfigurable and are disposed on an upper side of a corresponding outer node module of the plurality of outer node modules, wherein the plurality of unit modules are configured to connect to each other, and wherein each of the outer column modules includes a plurality of columns.

In another embodiment, the connecting the plurality of unit modules is performed on waters, and the plurality of unit modules includes a ballast system for controlling module draft during and after assembly.

In another embodiment, a connection support caisson is used between at least some of the plurality of unit modules to facilitate floating connection.

In another embodiment, the connecting the plurality of unit modules is performed on waters using a plurality of barges to support floating of the plurality of unit modules.

In another embodiment, the connecting the plurality of unit modules is performed by mechanical means, and wherein the mechanical means for connecting the plurality of unit modules is one or means selected from the group consisting of stabbing structures with locking pins, structural plates/tubulars, flanges, arrayed interlocking joints, receptacles and tab locking structures, ultra-high performance concrete, pin and hinge connection, and pin and box connection.

In another embodiment, a plurality of interface node extensions are used to connect a plurality of support trusses and the interface node.

In another embodiment, the support truss can be connected to the central pontoon.

BRIEF DESCRIPTION OF THE DRAWINGS

The features and advantages of the present disclosure will become more apparent to those of ordinary skill in the art by describing exemplary embodiments thereof in detail with reference to the accompanying drawings, in which.

DETAILED DESCRIPTION OF THE DISCLOSURE

Figure 1:
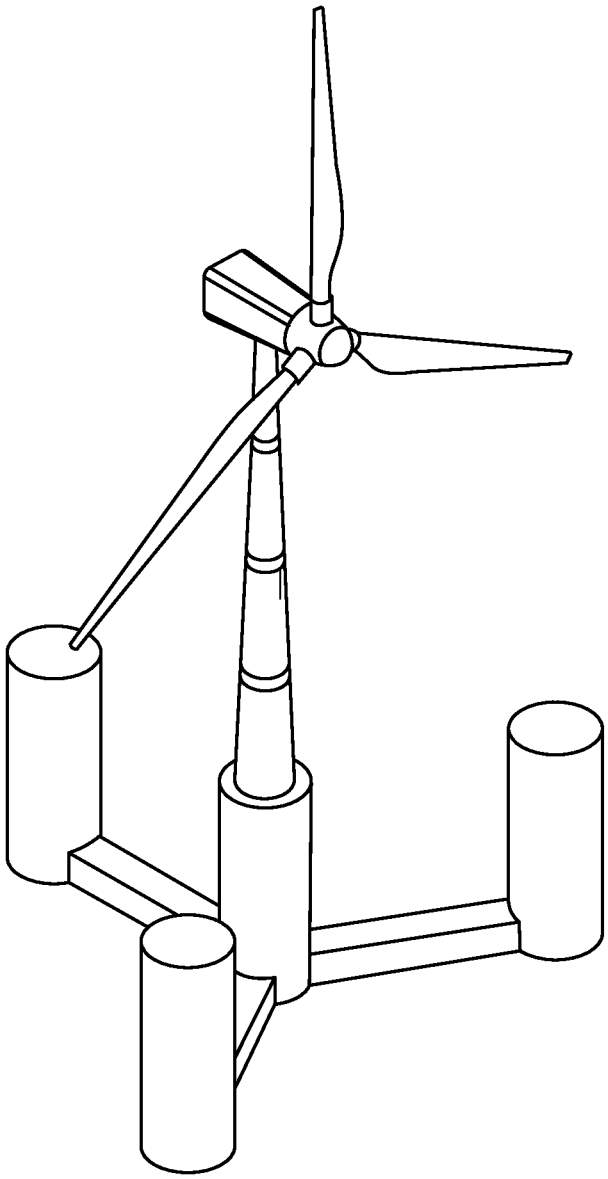
FIG. 1 PRIOR ART
FIG. 1 is a perspective view of a conventionally fabricated floating foundation (Semi-submersible or TLP type) supporting a horizontal axis wind turbine.

Reference will now be made in detail to embodiments of the present disclosure, examples of which are illustrated in the accompanying drawings. It is noted that wherever practicable, similar or like reference numbers may be used in the drawings and may indicate similar or like elements.

The drawings depict embodiments of the present disclosure for purposes of illustration only. One skilled in the art would readily recognize from the following description that alternative embodiments exist without departing from the general principles of the present disclosure. Various elements and regions are schematically illustrated in the drawings. Therefore, the scope of the present invention is not limited by the sizes or distances shown in the attached drawings.

Figure 2:
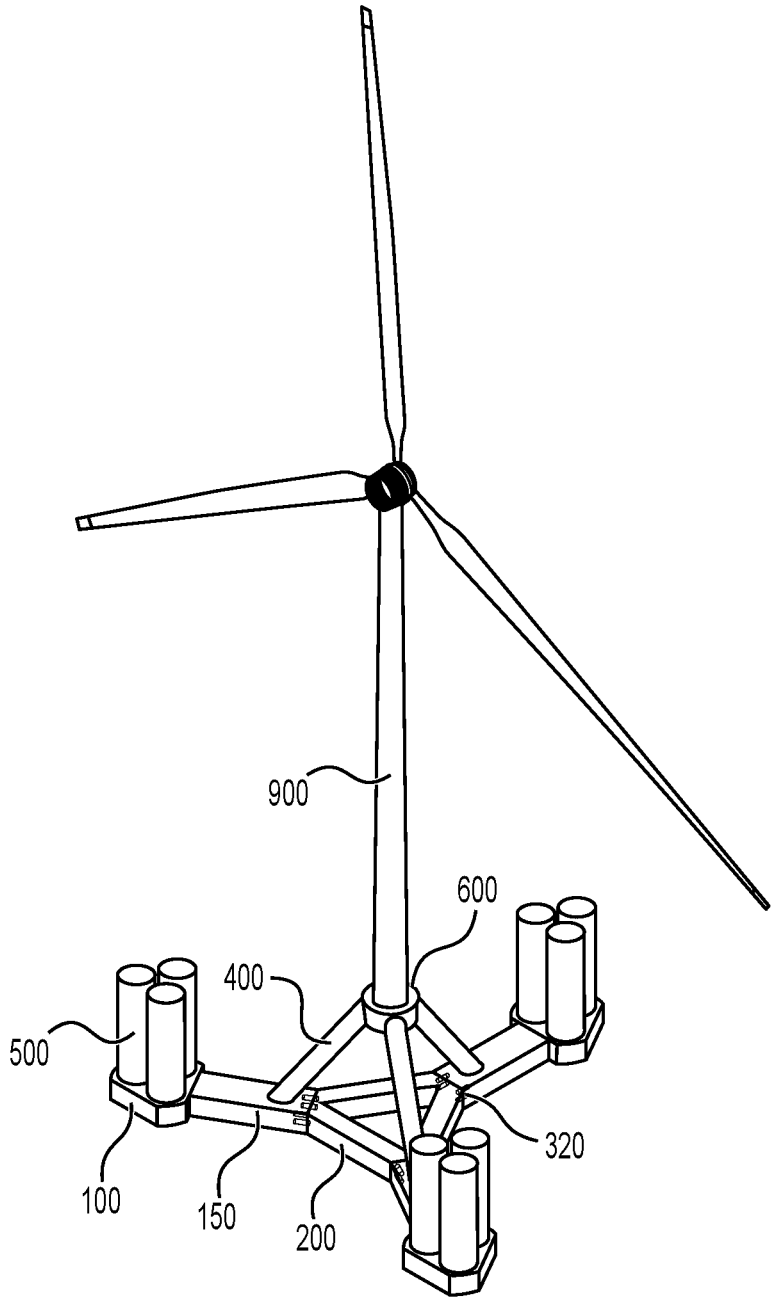
FIG. 2 is a perspective view of a floating foundation according to an embodiment of the present disclosure shown supporting a horizontal axis wind turbine.

In FIG. 2 there is shown a fully assembled platform according to an embodiment of the present disclosure. The modular floating platform includes a plurality of connectible unit modules including: outer nodes (100), outer pontoons (150), a central pontoon (200), support truss (400) with each leg of the support truss (400) connecting to an upper surface an outer pontoon, outer columns (500) connecting to the outer nodes (100) and an interface node (600). A horizontal axis wind turbine (900) may be connected to the interface node (600) on the floating platform. Other types of payloads, including vertical axis turbines (not shown) can also be connected to the interface node (600).

Figure 3:
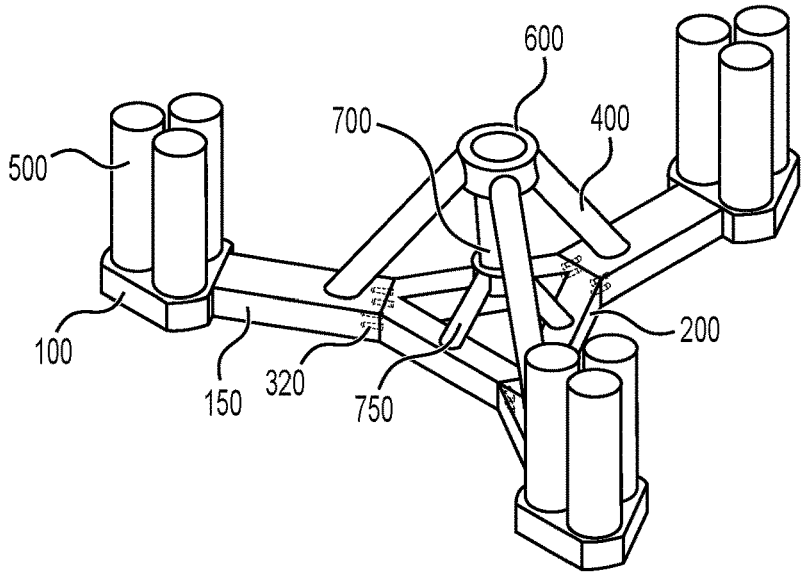
FIG. 3 is a perspective view of a floating foundation according to an embodiment of the present disclosure.

In FIG. 3, there is shown an assembled foundation according to an embodiment of the present disclosure with additional support structure. The modular floating foundation includes nodes (100), outer pontoons (150), a central pontoon (200), support truss (400), outer columns (500), an interface node (600) and a secondary central support column (700) connecting the interface node (600) to a secondary support truss (750). The secondary column (700) and secondary truss (750) provide additional flexibility and structural support for special or unorthodox interface requirements.

Figure 4:
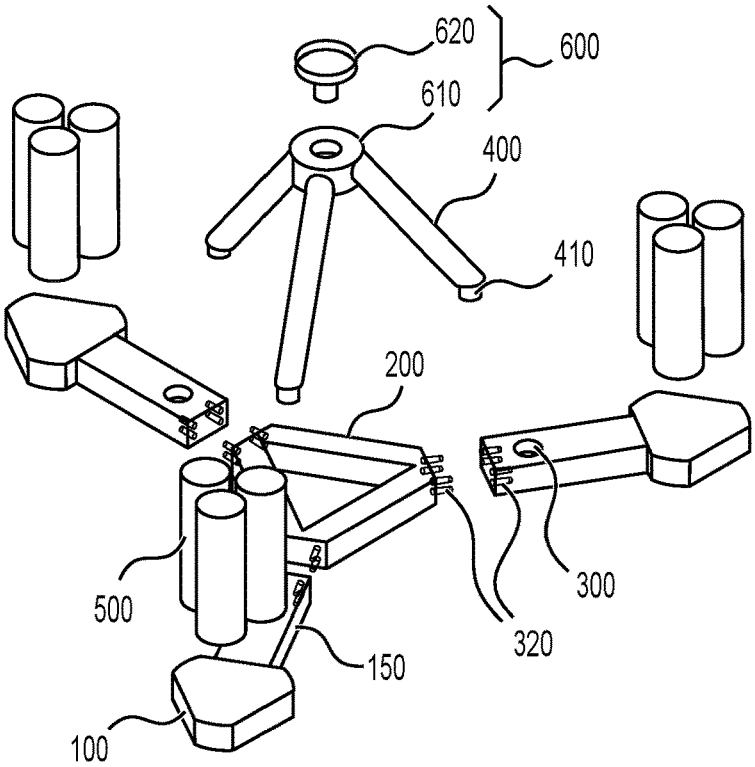
FIG. 4 is an exploded perspective view of a floating foundation according to an embodiment of the present disclosure.

In FIG. 4 there is shown an exploded view of the modules (100, 150, 200, 400, 500, 600) of the floating foundation. A key advantage of the foundation is that the modules can be fabricated in series at various facilities optimized for each module fabrication. The modules (100, 150, 200, 400, 500, 600) can be transported to an assembly point where they are then connected to form the foundation. The modules (100, 150, 200, 400, 500, 600) may be transported by means of road, rail or watercraft. Distributing module fabrication to various facilities reduces the project risk, including schedule and transport risk. Assembly of the modules (100, 150, 200, 400, 500, 600) into the foundation can be completed using existing, local infrastructure including shore based and afloat equipment and cranes.

The central pontoon (200) is located in the center of the floating foundation and has a plurality of sides and is connected to the outer pontoons (150). The nodes (100) are attached to the outer pontoons (150), and each cylindrical module forming the outer columns (500) is assembled to each node (100). Assembly of the support truss (400) integrated with the interface node (600) allows for a final completion of the foundation before the turbine (900) integration. It is possible for the support truss legs (400) and the interface node (600) to be connected to form a module to facilitate connection onto the pontoons (150). The interface node (600) includes a structural component (610) and a connection component (620) as shown in FIG. 4. The interface node, in particular the connection component, provides a point of connection of the wind turbine base (not shown) or other equipment base, to the foundation. The connection component (620) allows the interface node (600) to be reconfigurable to accommodate other wind turbines with different tower bases or other equipment and systems with different interface requirements.

The modules (100, 150, 200, 400, 500, 600) of the floating foundation may be separately manufactured at the same or different facilities and may be connected to one another to assemble the completed floating foundation at an assembly location prior to deployment to the operating site.

The assembled foundation including the assembled floating foundation unit modules (100, 150, 200, 400, 500, 600) and turbine (900) is suitable for installation at an offshore site and connected to catenary, semi-taut, taut or vertical tensioned mooring (not shown).

Figure 5:
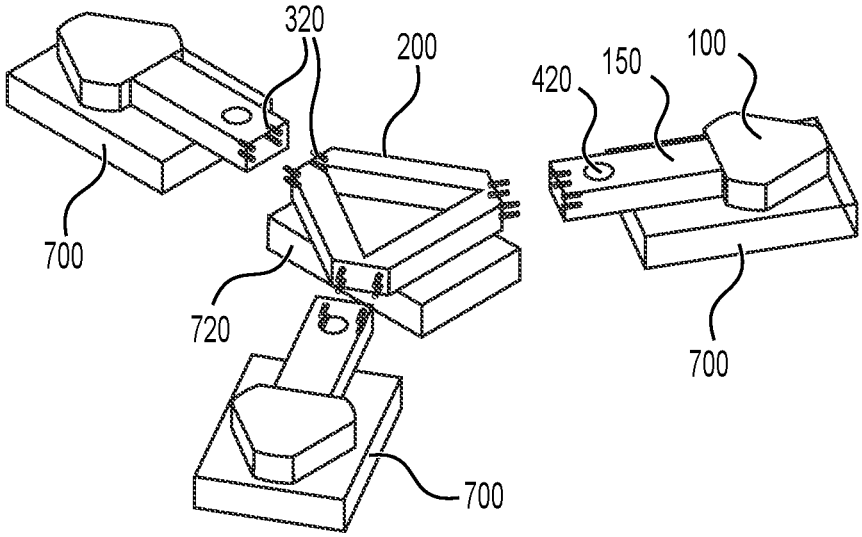
FIG. 5 illustrates a means of assembling a floating foundation according to an embodiment of the present disclosure.

In FIG. 5 there is shown a feature of the disclosure that allows for assembly of the modules (100, 150, 200) on water using submersible or conventional barges (700, 720).

An additional afloat assembly method of the modules (100, 150, 200) without use of barges uses ballast control of the nodes (100) and pontoons (150, 200) or any combination thereof (not shown).

An assembly afloat without the use of barges called self-float assembly includes several steps and utilizes the inherent positive buoyancy of the modules. Each module is outfitted with a ballast system including pumps, valves and piping, that are used to control module draft during and after assembly. Modules that are to be assembled are ballasted to the draft required for assembly. Tugs or workboats can be used to push or pull the modules together for assembly. Alternatively, temporary winches mounted on the modules can use rope, wire or chains to pull modules together for assembly. The same connection methods used to assemble modules afloat using barges can also be used to connect modules during the self-float assembly.

Figure 6:
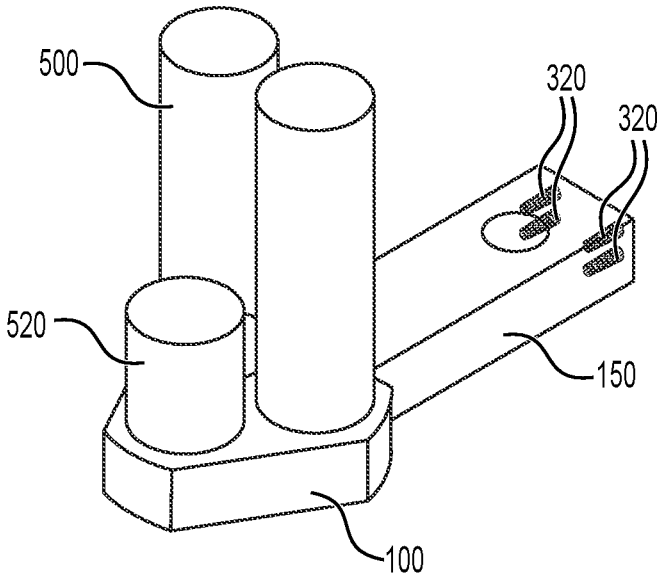
FIG. 6 is a perspective view of a reconfigured outer column assembly on a node illustrating an embodiment of the present disclosure.

In FIG. 6 there is shown an embodiment of a reconfigurable arrangement of the outer columns (500). Outer columns (500) may be reconfigured by adjusting the number of outer columns connected to the nodes (100) and by installing modules of different heights for the outer columns (500, 520) which are mounted on the nodes (100).

Figure 7:
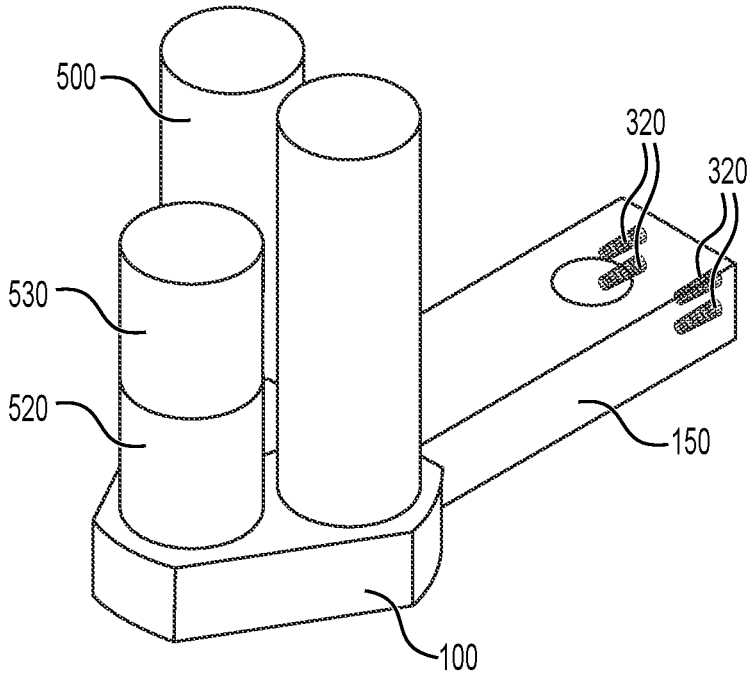
FIG. 7 is a perspective view of a reconfigured outer column assembly on a node illustrating an embodiment of the present disclosure.

Each of the outer columns (500) may include an assembly of smaller, buoyant modules (FIG. 7, 520, 530) which are then connected to form the buoyant column module (500). Outer column modules (500, 520, 530) may be fabricated from steel, concrete or synthetic materials, such as high density synthetic polymers or syntactic type foams. Outer column buoyant modules (500) may include assemblies of modules (520, 530) including different materials. An example of a buoyant module assembly (500) is a steel lower section (520) connected to a solid foam upper section (530).

The buoyant modules (500) may be cylindrical or other volumetric shapes. Cylindrical buoyant modules have fabrication advantages in that they may include hollow rolled pipes of standard mill sizes, which results in lower material costs, wider supply availability and more efficient fabrication of the modules (500).

Outer column modules (500,520,530) may be removed or added after the foundation has been secured with the mooring system (not shown) at the offshore site. In addition, the features of the plurality of reconfigurable columns for the outer columns (520, 530) can lower the hydrodynamic loads compared to a large single column of a conventional floating foundation of the type indicated in FIG. 1. Modular outer columns (500, 520, 530) can improve the overall foundation fabrication efficiency compared to a large single column of a conventional floating foundation. Reconfigurable, modular columns (520, 530) allow the use of different materials which can result in lighter foundations and again, improve column fabrication efficiencies and can further reduce outer column cost.

Figure 19A:
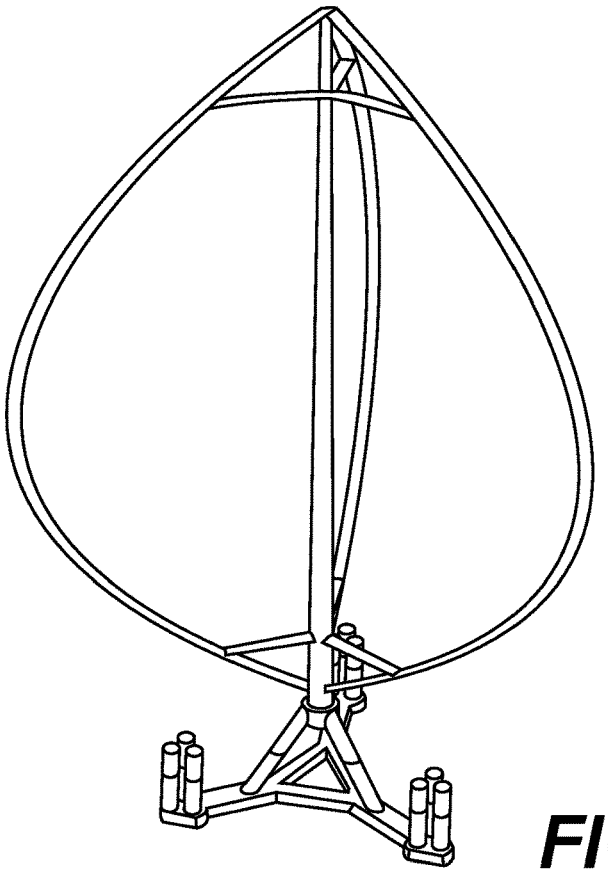
FIG. 19 illustrates (a) a floating platform having reconfigurable multiple columns, and (b) and a conventional floating platform having single columns, with a VAWT connected on the top of each floating platform center.
Figure 19B:
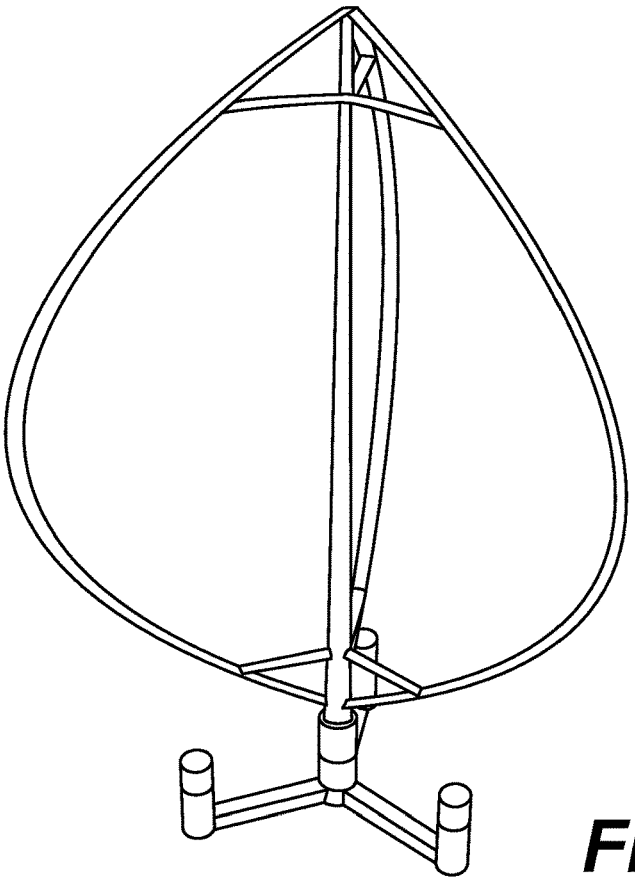

Two different Tension Leg Platforms (TLPs) with a Vertical Axis Wind Turbine (VAWT) in FIG. 19 are considered to investigate the dynamic performances of the reconfigurable multiple column platform. FIG. 19 (*a*) shows a reconfigurable multiple column platform of the disclosed invention, while FIG. 19 (*b*) represents a single large column platform similar to the platform in FIG. 1. Both platforms supporting a 10 MW VAWT are assumed moored with vertical tethers with a high pre-tension to maintain its stability. Dynamic response analysis was conducted for both platforms under the turbine operating wind speed along with associated waves and currents.

Figure 20:
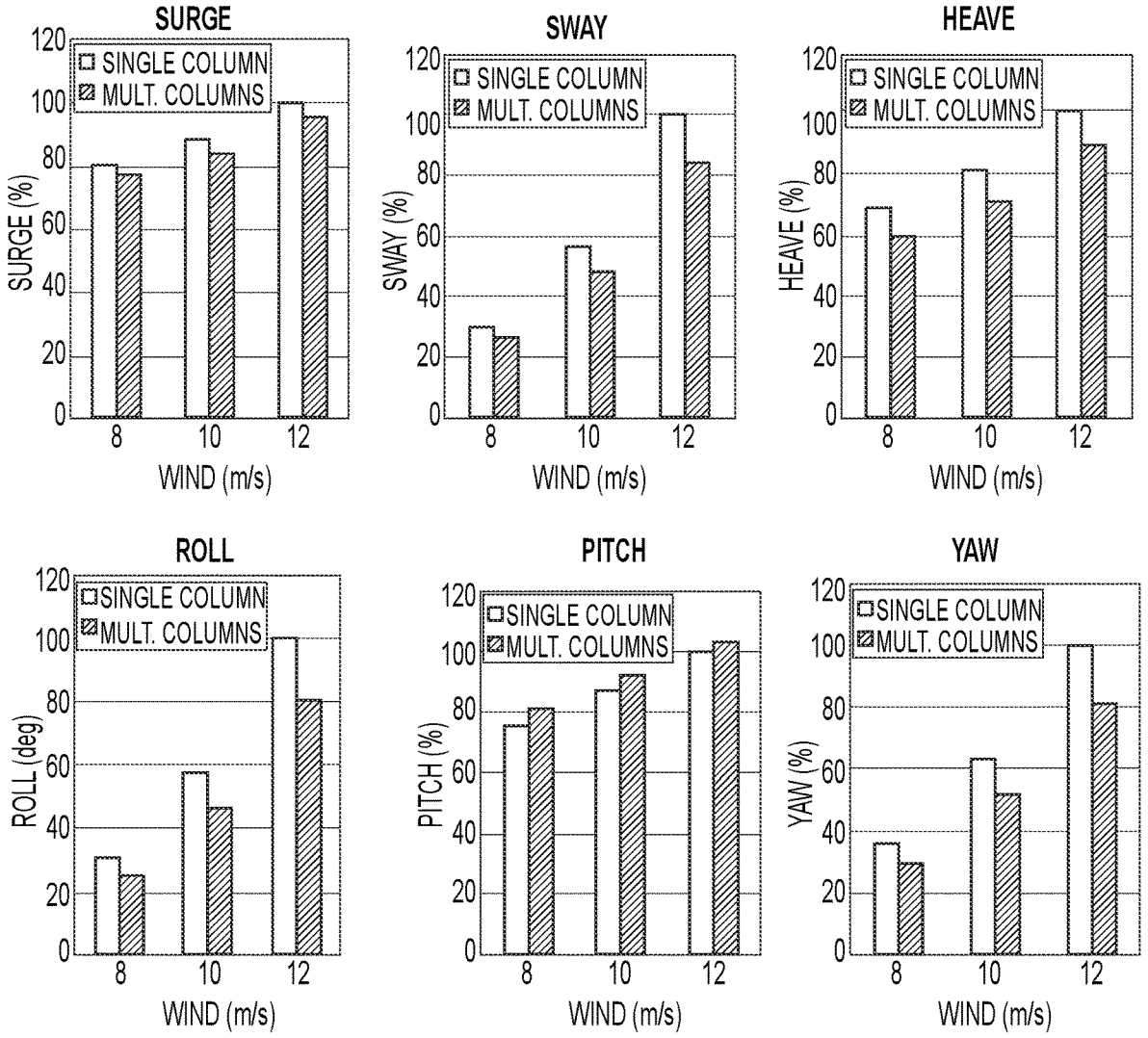
FIG. 20 are graphs showing floating platform motion comparisons between the floating platform of FIG. 19(*a*) and the floating platform of FIG. 19(*b*)

The resulting platform motions are compared in FIG. 20, for wind speed of 8, 10 and 12 m/s among the whole ranges of the operating wind. Each motion of both platforms is normalized with each motion of the largest single column platform for the wind speed of 12 m/s so that the presented values are percentage (%) with respect to the value mentioned. The motions of the multiple column platform are smaller than the values of the large column platform, except the pitch motion. However, it was confirmed that the pitch motions become lower than the value of the single column platform as the wind speed increases toward the cut-out wind speed of 25 m/s. The lower motions of the multicolumn platform can result in lower loads on the structural members and mooring tethers, indicating the advantages of the foregoing platform.

Outer column modules (500, 520, 530) may be assembled to the nodes (100) by structural stabbing type connections (320), welding, bolting or grouting or any combination thereof. In addition, outer column modules (500, 520, 530) may be assembled to nodes (100) using chains and chain fittings, master links, turnbuckles or other mechanical tie-downs or pull-ins.

Figure 8:
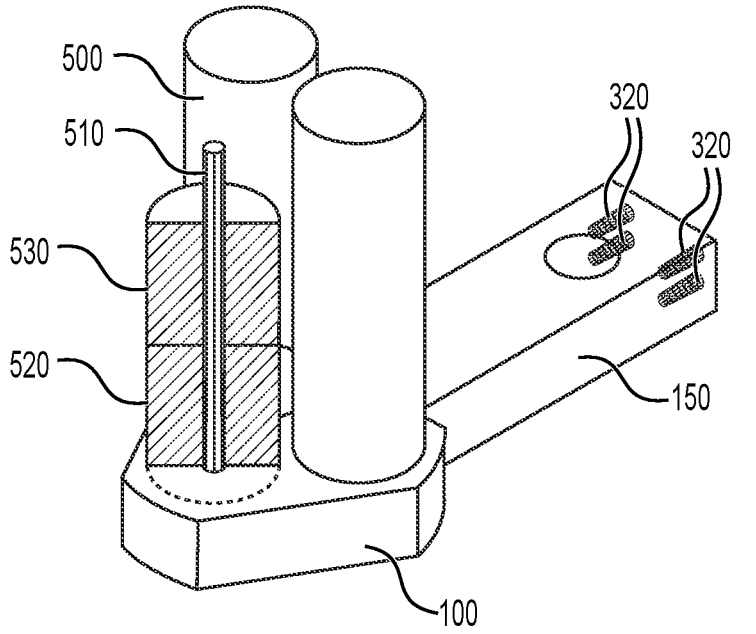
FIG. 8 is a perspective view with a partial section view of an outer column assembly on a node illustrating an embodiment of the present disclosure.

FIG. 8 illustrates another means of assembling outer column modules (500, 520, 530) to the nodes (100) by using a rigid central connection post (510, a Module Center Post). The outer column modules (500, 520, 530) can be slid onto the rigid central post (510) and secured in position using straps, clamps and or collars. Another means is to have the central column post (510) and outer column modules (500, 520, 530) partially or completed threaded and then connected.

In another embodiment (not shown), a rigid post is centered on the nodes (100) and the outer column modules (500, 520, 530) are attached to the rigid post by clamps or mechanical means.

In another embodiment, nonrigid materials such as a chain, wire or polyline may be used instead of central rigid posts (510), which can allow the modules (500) to move around the connection pivot, reducing stress at the connection.

Outer columns (500, 520, 530) may be sized to match standard structural pipe mill sizes such as 5, 7 or 9 m diameter structural pipes. Additional structural pipe size diameters are also commercially available.

In another embodiment (not shown) the outer column modules (500, 520, 530) may then be connected to the node (100) using a threaded receptacle, a slotted catch receptable or a similar method. For the threaded receptacle connection, a large diameter threaded member is attached to the bottom of the outer column module (500) and a corresponding threaded receptacle is embedded in or attached to the node (100). To attach the outer column module (500) to the node (100) the threaded connections are aligned and then the outer column module (500) is rotated to engage the threads. For the slotted catch receptacle, the connecting device mounted to the bottom of the outer column module (500) is inserted into a receptacle on the node (100). The outer column module (500) is then rotated until the slotted catch receptacle is in a locked position, a position that secures the outer column module (500) from vertically detaching from the node (100).

The central pontoon (200) shortens the outer pontoons (150) compared to a conventional floating foundation. The central pontoon (200) together with the support truss (400) distributes the dynamic loads from a wind turbine (900) through the interface node (600) into the pontoons (150) and nodes (100) more efficiently than a foundation with a conventional large center column and pontoon configuration depicted in FIG. 1. This structural configuration reduces load and stress concentrations at the interface node (600) to support truss (400) connection and at the support truss (400) to outer pontoon (150) connection when compared to the load and stress concentration of existing conventional floating foundation designs wherein pontoons attach to center columns directly.

The support truss (400) and outer columns (500) may have circular or polygonal cross section shapes, including square or hexagonal cross section.

Figure 21:
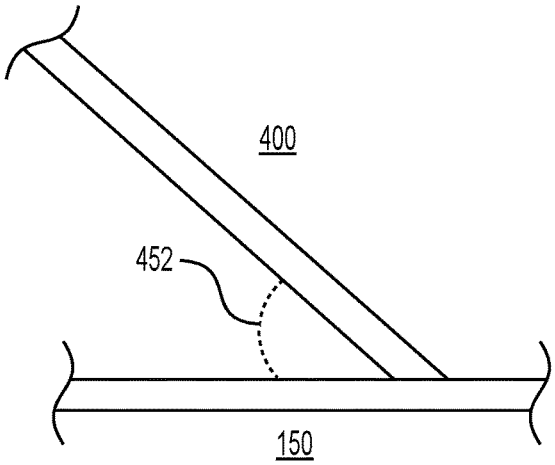
FIG. 21 illustrates a connection angle between a support truss and outer pontoon.
Figure 22:
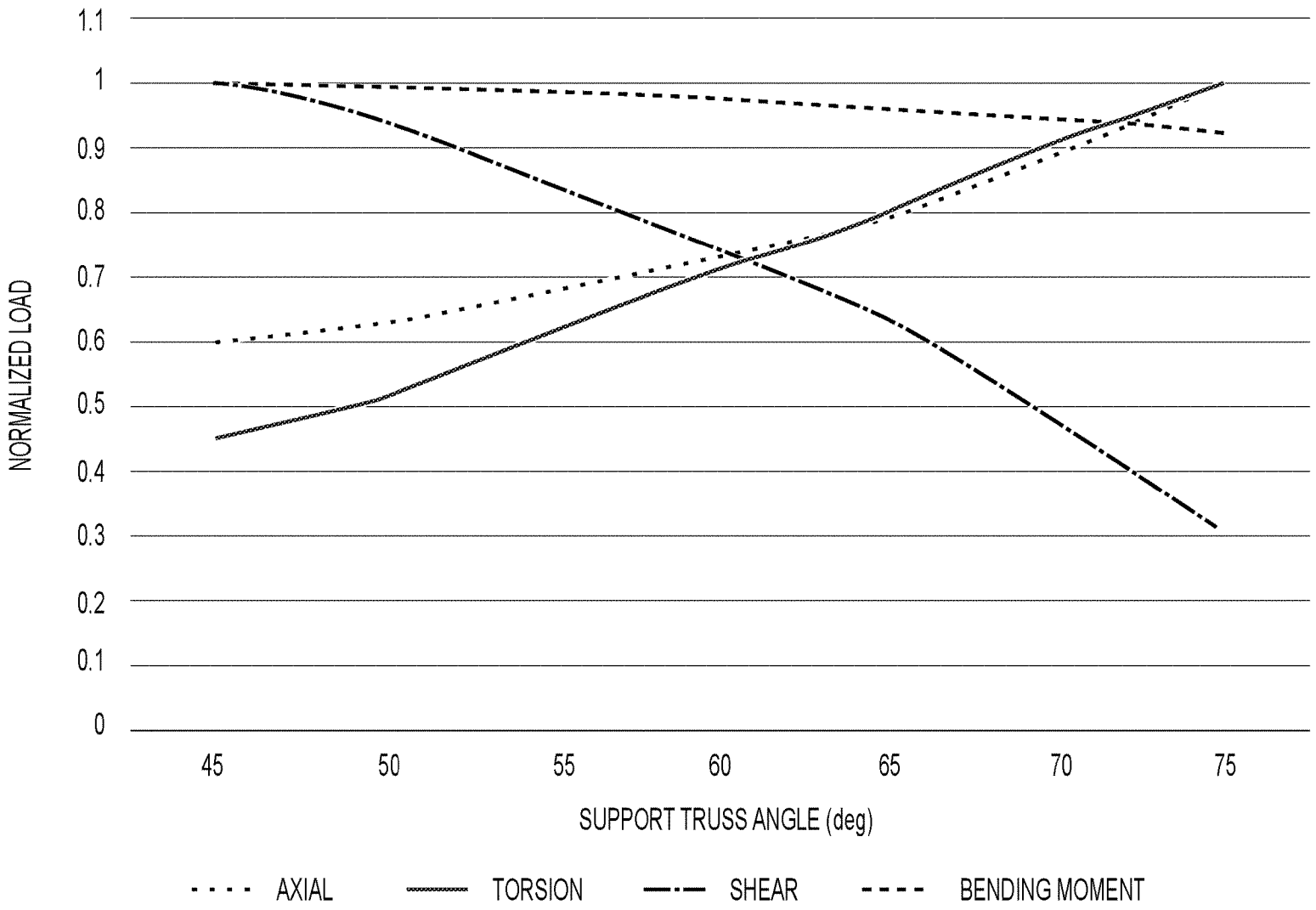
FIG. 22 is a graph showing the normalized load values for a support truss attached to an outer pontoon at various connection angles.

FIG. 21 shows a connection angle (452) of a support truss (400) that is connected to an outer pontoon (150). The angle (452) is measured between the top of the outer pontoon (150) and the longitudinal axis of the support truss (400). The optimal angle (452) for the connection is between 45 degrees and 60 degrees as shown in FIG. 22. The angle range was determined by iterating the connection angle (452) for a structural model analysis of the foundation. Angles greater than 60 degrees will result in rapid load increases in the support truss (400). Angles less than 45 degrees may result in the support truss (400) extending past the ends of the outer pontoon (150) and thus should be avoided.

The support truss (400) may be connected and secured to the outer pontoons (150). The support truss (400) is vertically stabbed into the outer pontoon (150) using a vertical pin (410) fitted into a receptable (300) on the outer pontoon (150). This connection can be bolted, welded and grouted.

In another embodiment, the support truss (400) may be connected to the central pontoon (200).

FIGS. 2 to 9 show structural stabbing connections (320) aligned horizontally, to connect the outer pontoons (150) and the central pontoon (200). The pin type connections (320) include an insert element (321) and a receptacle (322). Although not shown, structural stabbing connections (320) may be used to connect other modules, e.g., the nodes (100) and the outer pontoons (150). Further, pin type connections (320), may be disposed laterally, vertically or at an angle to connect modules (also not shown).

Figure 9:
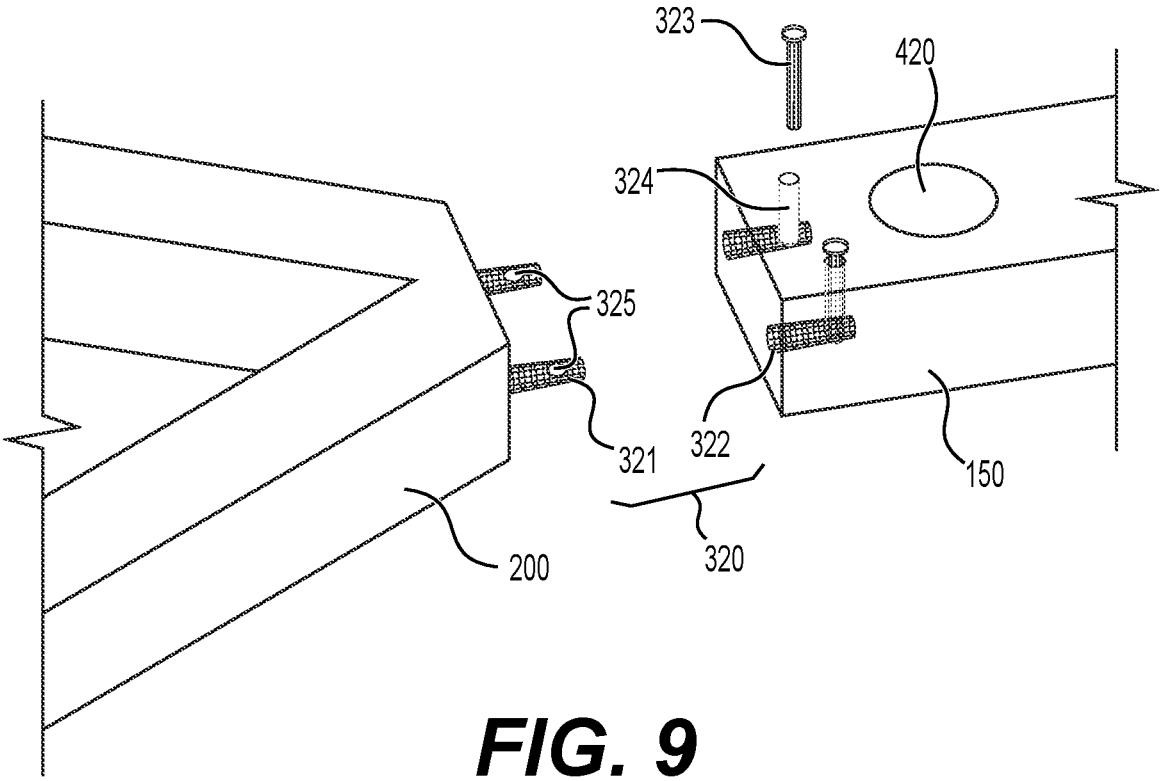
FIG. 9 is a perspective view of a connection between a central pontoon to an outer pontoon according to an embodiment of the present disclosure.

FIG. 9 shows a locking pin (323) that is vertically stabbed through a channel (324) in the outer pontoon (150) and through the structural insert element (321) fitted with a locking pin receptacle (325). Structural stabbing may also be horizontal, lateral, vertical and angled. The locking pin (323), channel (324) and pin receptable (325) may be threaded.

Figure 10:
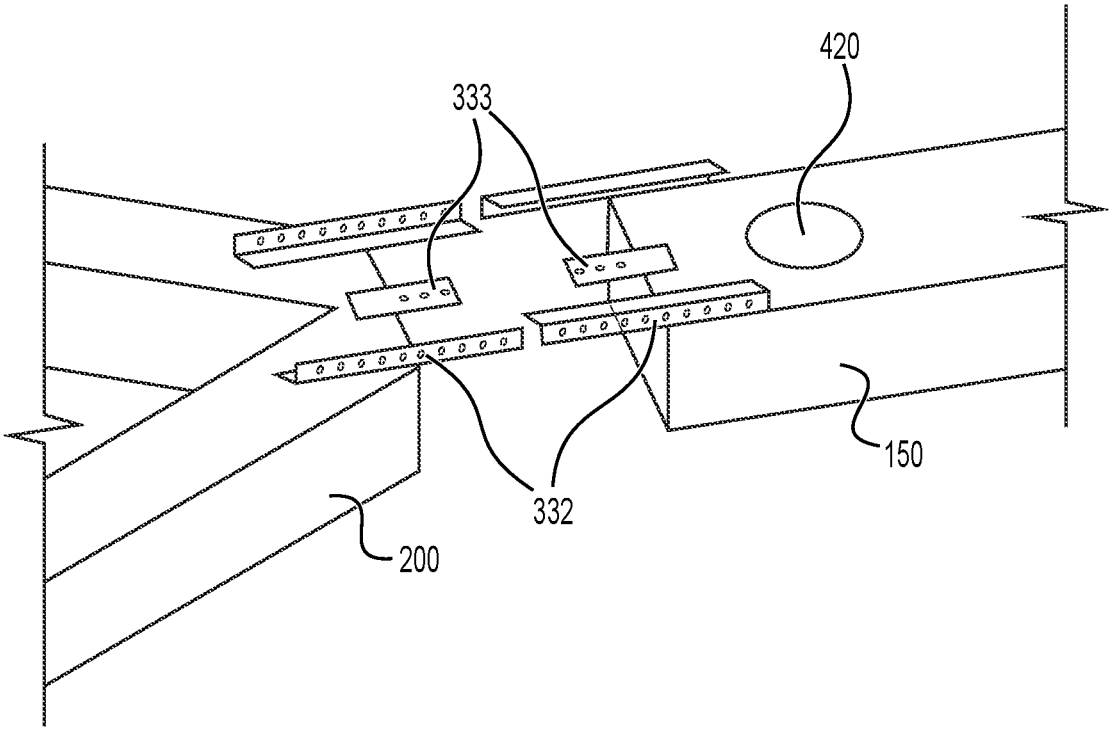
FIG. 10 is a perspective view of a connection between a central pontoon and an outer pontoon according to an embodiment of the present disclosure.

The outer pontoons (150) may be connected to the central pontoon (200) using a structural member such as plates, shape or tubulars. FIG. 10 shows structural shapes (angles) and plate connections (332, 333) on the top of the central pontoon (200) and top of the outer pontoon (150). Structural shapes of various types and various structural plate configurations may be applied over any or all module surfaces. As the central pontoon (200) and outer pontoon (150) modules are brought together for assembly, the shapes and plates (332, 333) are aligned and then bolted or welded together to integrate the modules (150, 200) together in the final assembled configuration. Structural members for connection may be used horizontally, vertically or laterally at module interfaces and for other modules such as between the outer pontoons (150) and nodes (100).

Figure 11:
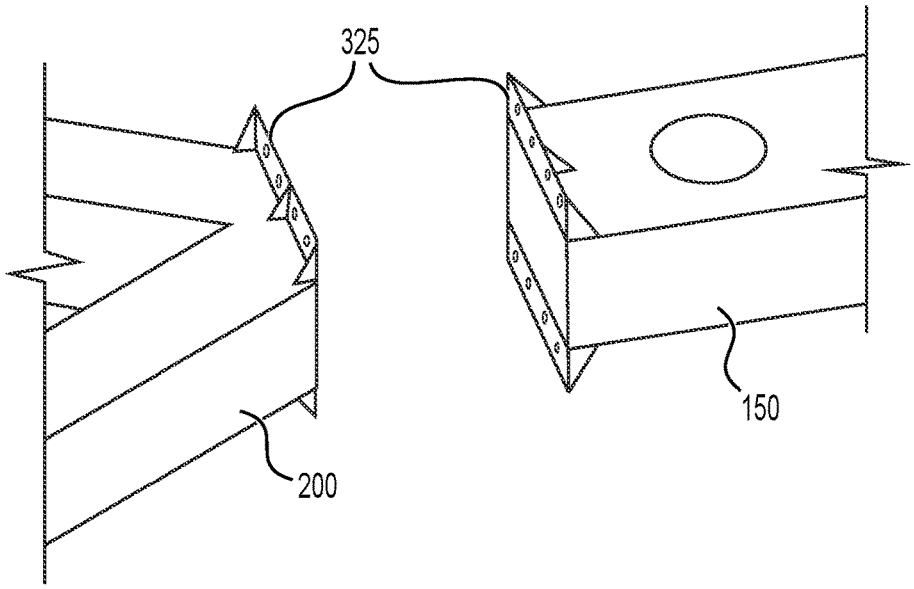
FIG. 11 is a perspective view of a connection between a central pontoon and an outer pontoon according to an embodiment of the present disclosure.

In FIG. 11, a flanged system (325) may be used at the interfaces between the modules (100,150,200). The flange system (325) may be bolted or welded together. The flanges may be arrayed along any modules interface boundary and may be continuous or intermittent.

Figure 12:
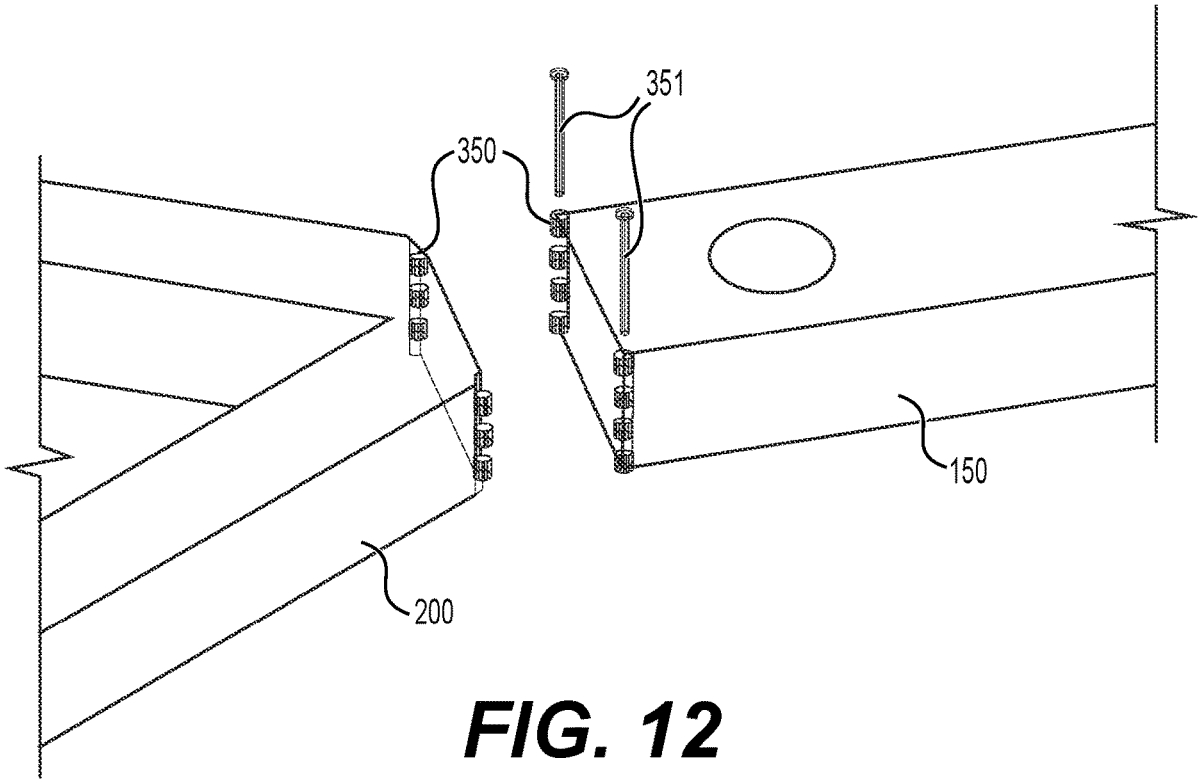
FIG. 12 is a perspective view of a connection between a central pontoon and an outer pontoon according to an embodiment of the present disclosure.

FIG. 12 shows arrayed interlocking joints (350,351) at the vertical boundaries of a central pontoon (200) and outer pontoon (150). The arrayed interlocking joints (350,3551) include an array of structural receptacles (350) that are meshed when assembled and secured by a locking pin (351). The structural receptacles (350) may be located externally to the modules or internally, as integral parts of the modules. Arrayed interlocking joints (350, 351) may be oriented vertically, horizontally, laterally or at an angle to the interface or boundary edges of any module (100, 150, 200). After the locking pin (351) is inserted into the arrayed structural receptacles (350) the locking pin (351) may be secured by threading, welding or other means.

Figure 13:
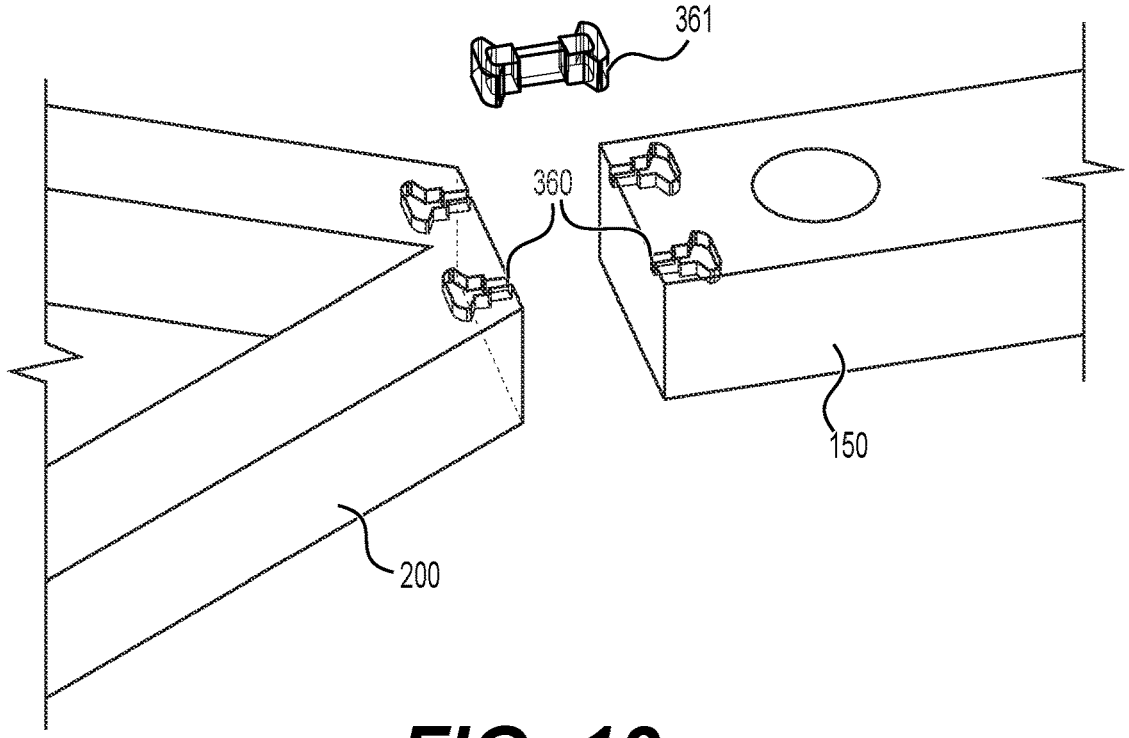
FIG. 13 is a perspective view of a connecting between the central pontoon and an outer pontoon according to an embodiment of the present disclosure.

Receptacles (360) and tab locking structure (361) are shown for connecting the central pontoon (200) and outer pontoon (150) in FIG. 13. The receptacles are included in the fabrication of the modules (150, 200). The tab locking structure (361) is fabricated to match the receptacles (360) and the tab locking structure (361) is inserted into the receptacles (360) after the modules (150, 200) are brought together for assembly. The tab locking structure (360) may include a plurality of sub-assemblies or include elements which make the tab locking structure (360) extendable, retractable or foldable. The tab locking structures (361) may be secured into the receptacles (360) by bolting, welding or grouting or any combination thereof.

Figure 14:
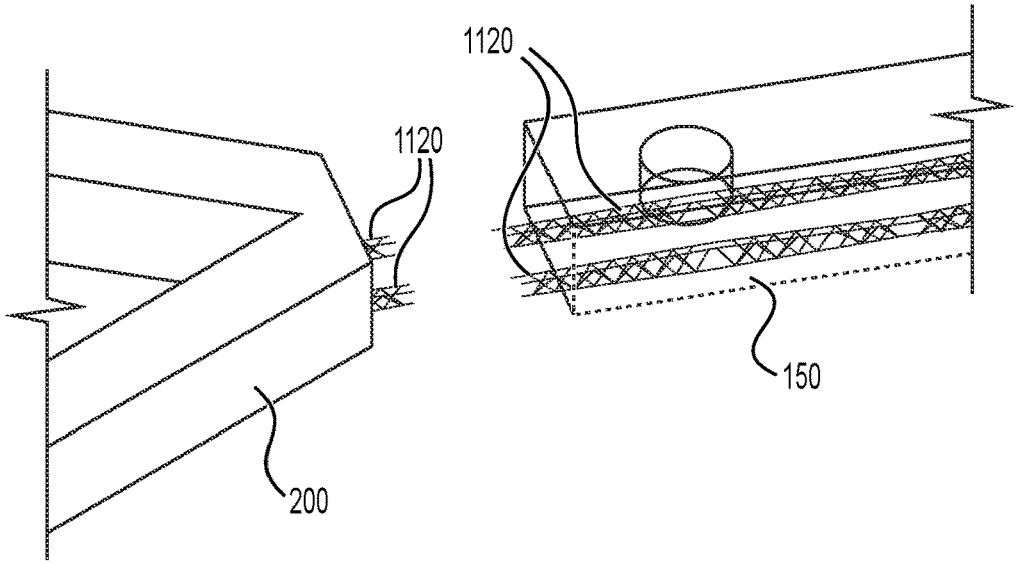
FIG. 14 is a perspective view of an internal endo-structural system connecting an outer pontoon module to a central pontoon module according to an embodiment of the present disclosure.

An endo-structural system (ESS) (1120) internally placed in the outer pontoon (150) and/or central pontoon (200) may be used to connect the two modules. FIG. 14 shows an example with a pair of the ESS between pontoons (150, 200). The ESS (1120) includes a plurality of structural members such as tubulars, shapes or built-up sections that internal to the outer pontoon (150) or central pontoon (200). The ESS can act as a primary load bearing structure to take the foundation loads from the turbine and mooring, while the pontoon structure (150, 200) surrounding the ESS is a secondary structure that provides buoyancy to the pontoon and foundation. The ESS secondary structure can be fabricated with lighter weight structures (steel or concrete) which may reduce the pontoon weight and hence the total foundation structure weight. An advantage of using an ESS is that the ESS can be optimized to support the turbine and mooring loads through the foundation, while surrounding the ESS lighter weight structures (steel, concrete) can be optimized to provide buoyancy for the foundation. The member ends of the ESS (1120) may protrude beyond the ends of the modules (150, 200), to facilitate connection between modules such as an outer pontoon (150) and outer node (100). An ESS may also be used in the central pontoon (200), outer nodes (100), outer columns (500) and support truss (400).

Figure 15:
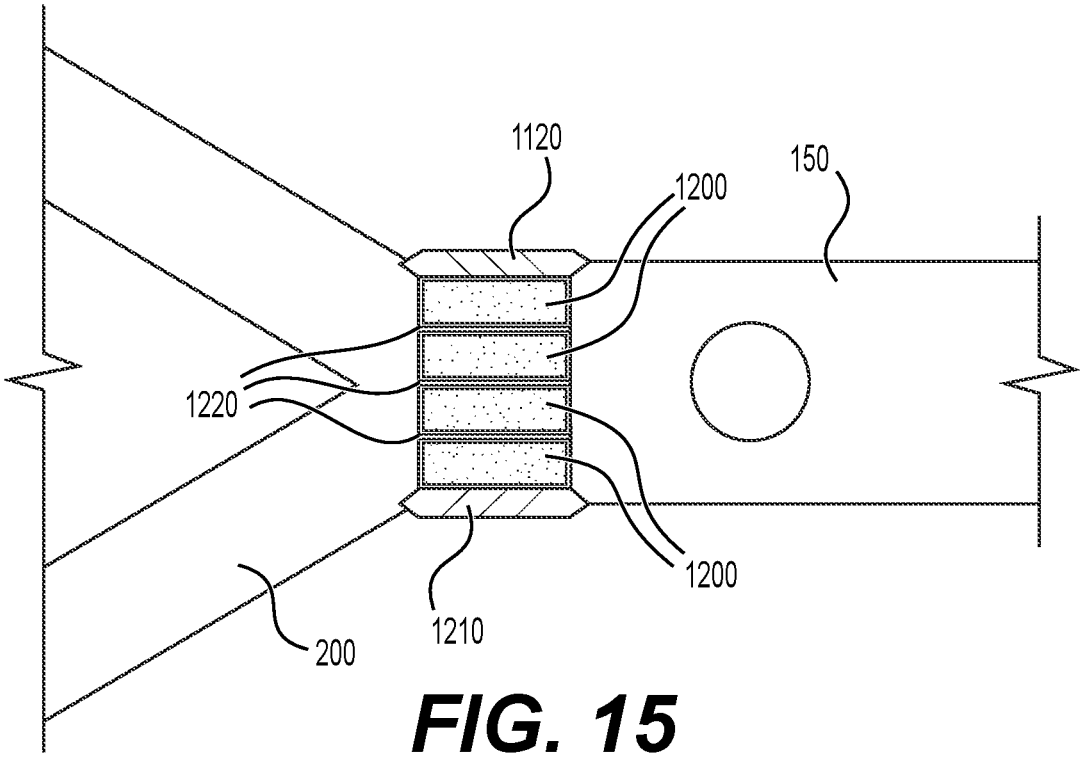
FIG. 15 is a plan view of a connection between an outer pontoon and a central pontoon according to an embodiment of the present disclosure.

FIG. 15 shows a connection between an outer pontoon (150) and a central pontoon (200) that uses ultra-high performance concrete (1200), spacer structures (1210) and wires (1220) to bind the two modules together. Before tensioning the wires (1220), spacer structures (1210) are placed between pontoons (150, 200), in order to allow tensioning of the wires (1220). Anchor points of the wires (1220) can be located inside the fabricated pontoons modules (150, 200). The wires (1220) may be fabricated in two parts and then connected using links. The spacer structures (1210) may include mechanical systems such as threaded rods or hydraulic rams or any other means of separating the modules (150, 200) when the wires (1220) are tensioned. The spacer structure is removed to produce a compression to the concrete once the connection strength is achieved. Advantages of using ultra-high performance concrete include its greater durability resistance to cracking, compared to more traditional concretes.

Figure 16:
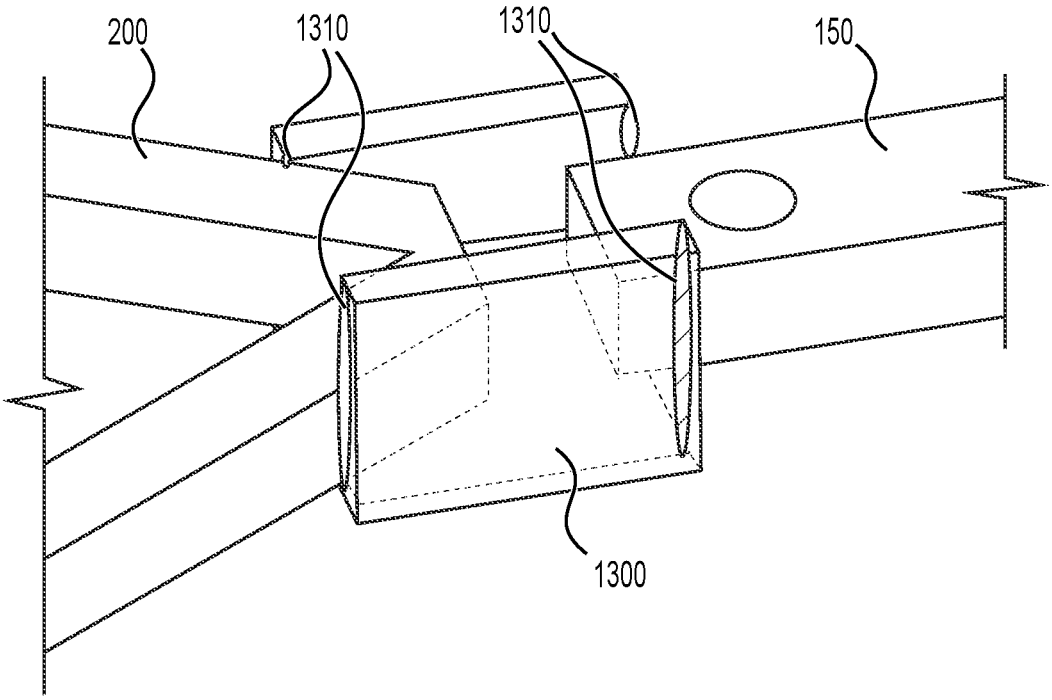
FIG. 16 is a perspective view of a connection support caisson used to connect a central pontoon module to an outer pontoon module according to an embodiment of the present disclosure.

Module connection between an outer pontoon (150) and a central pontoon (200) or an outer pontoon (150) and outer node (500) can be made on water without submersible barge or conventional barge (700, 720) by using a temporary connection support caisson (1300). FIG. 16 shows a connection support caisson (1300) attached around an outer pontoon (150) and central pontoon (200) floating on water. A connection support caisson (1300) is temporarily attached between modules to provide a dry space for module connection to be completed. The connection support caisson (1300) includes buoyant structures and deformable sealing gaskets or membranes, a ballasting system and a dewatering system. The connection support caisson (1300) is submersible and is floated in place around the module ends to be connected. Connection support caissons allow for module assembly to be completed when the modules are afloat and not on a barge and when the connection method requires dry access to be completed.

When a connection support caisson (1300) is attached to the modules, the water inside the connection support caisson (1300) is pumped out and the connection support caisson (1300) is kept in place by external hydrostatic pressure on the connection support caisson (1300). A polymer or other type deformable gasket (1310) attached to the connection support caisson (1300) ensures a watertight seal between the connection support caisson (1300) and the modules (150, 200). The connection support caisson (1300) can also be used to support a mold for a high-performance concrete (1200). After modules (150, 200) connection, the temporary support caisson is removed.

FIGS. 8-16 show various assembly methods of the outer pontoon module and the central pontoon module. The various assembly methods may be used for assembling other modules of the floating foundation.

All module connections may further be supplemented with polymer and cement based adhesive compounds.

Figure 17:
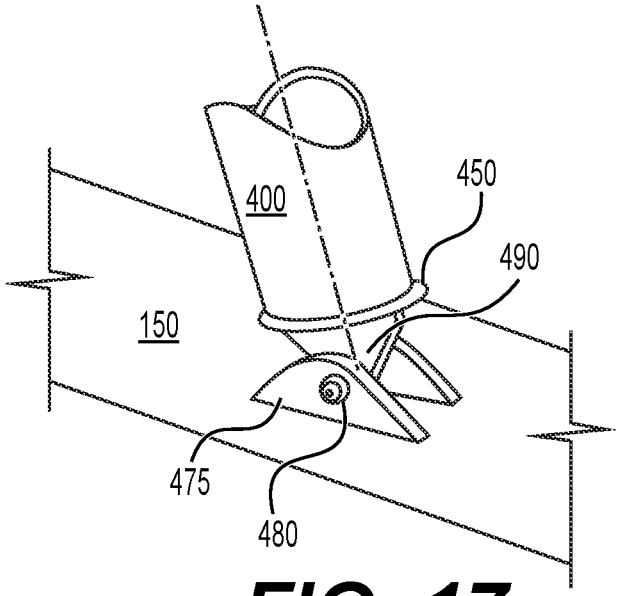
FIG. 17 is an isometric view of a hinge and pin connection used to connect a support truss to an outer pontoon according to an embodiment of the present disclosure.

FIG. 17 shows another means of connecting a support truss (400) to an outer pontoon (150) using a structural hinge (475) and pin (480). A flange (450) or a similar thick plate structure (450) may be used for the support truss (400) to attach an extension structure (490) or tapered truss support structure to the flange (450). Structural pins (475) and hinges (480) may be used to connect other modules.

Figure 18:
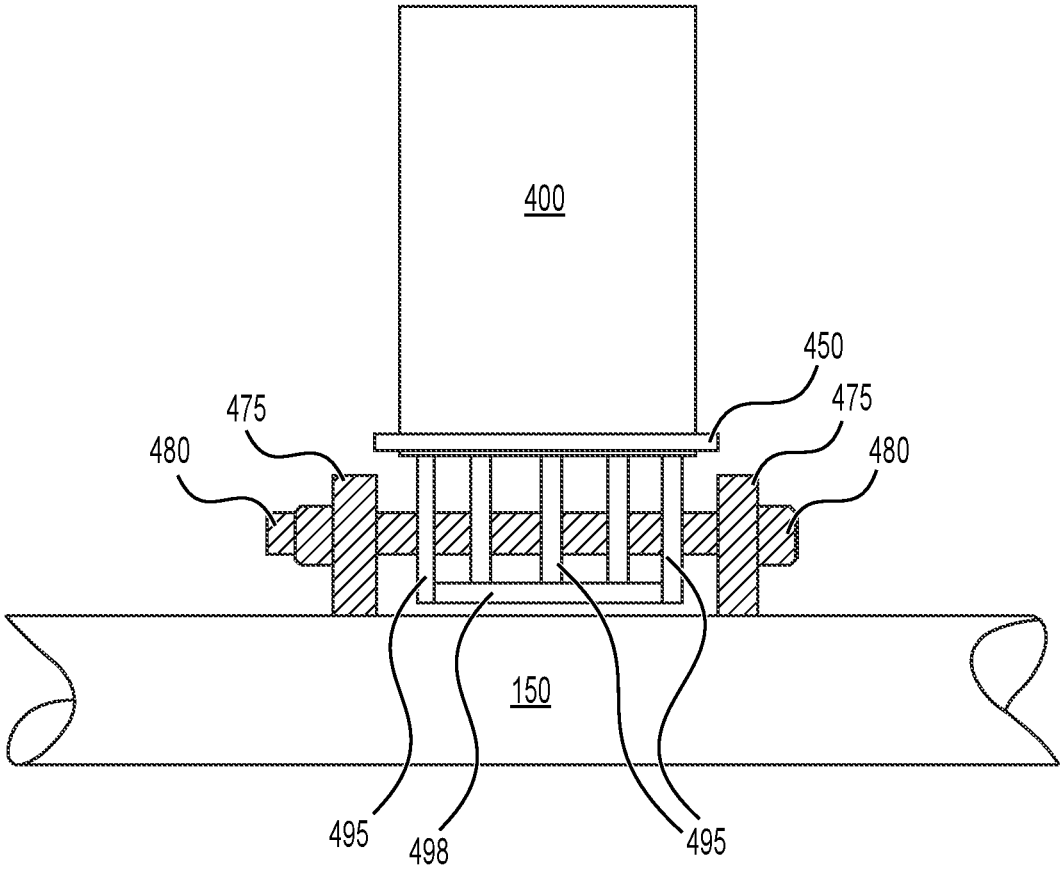
FIG. 18 is a section view of a hinge and pin connection using multiple extension structures according to an embodiment of the present disclosure.

FIG. 18 shows another hinge and pin connection method using multiple extension structures (495, MES) attached to the bottom end of the support truss (400). An end plate (498) attached to the bottom end of the extension structure may be used to improve the strength of the extension structures (495). Additional internal hinges (not shown) can be placed within the external hinge (475). This multiple extension structure method can reduce the connection load at the end of the support truss (490) due to the distribution of the connection load across multiple extension structures (495). Using a MES can improve the connection strength and reduce the stresses at the bottom end of the supporting truss (400).

Another means of connecting modules is to use pin and box type mechanical connections. In a pin and box type connection, a threaded pin is inserted into a threaded box. Hydraulic pressure is used to force apart the box to allow the threads of the pin to fully engage the threads of the box.

Once the threads are completely engaged, the hydraulic pressure is released to complete connection between modules.

The nodes (100), pontoons (150, 200), support truss (400), columns (500, 520, 530), interface node (600) and secondary support (700, 750) may be fabricated from steel, concrete or a combination of these materials. The columns (500, 520, 530) may also be fabricated, in whole or in part, from syntactic type foam, or similar synthetic materials.

Figure 23:
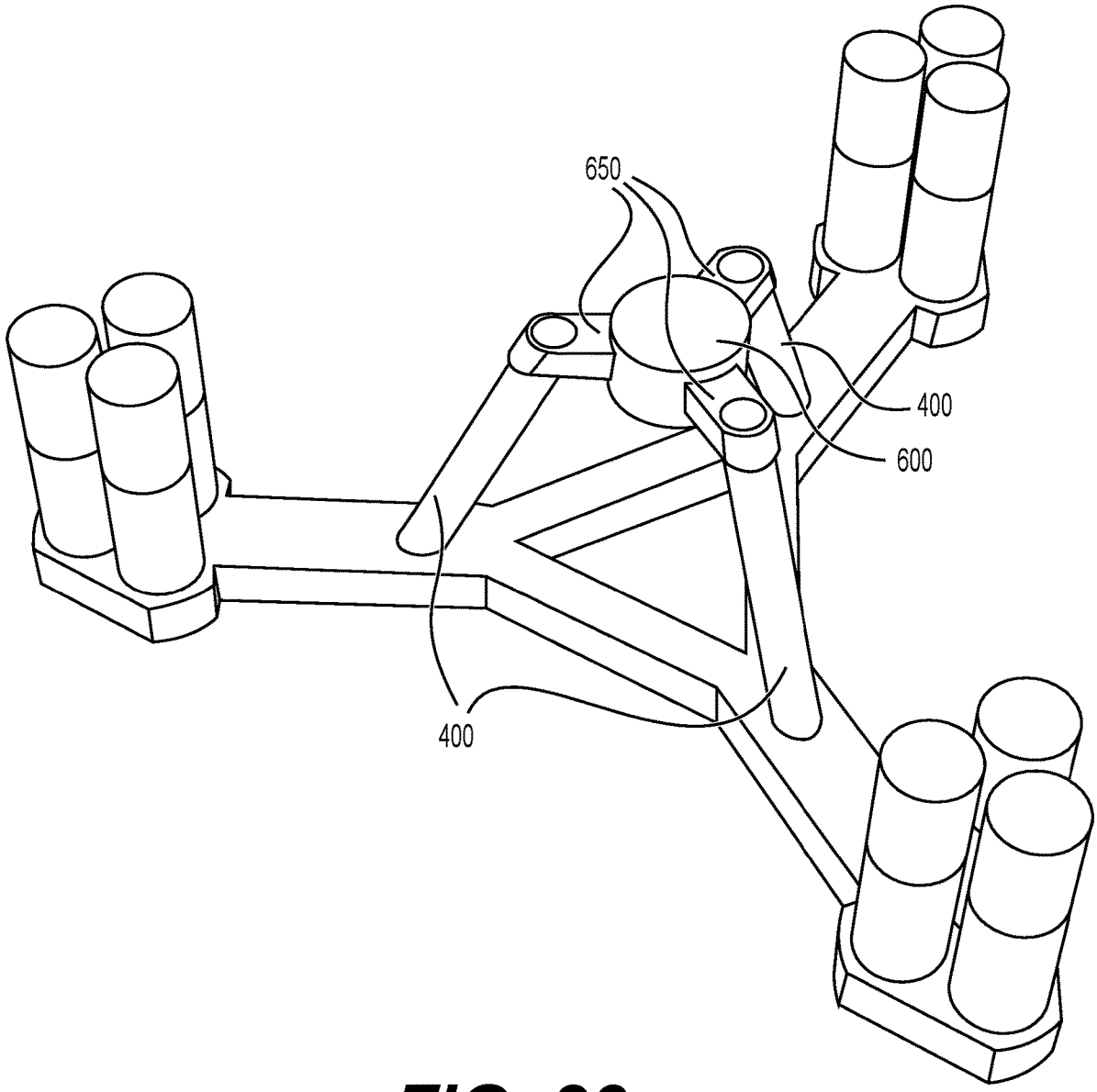
FIG. 23 is a perspective view of an embodiment of the support truss and interface node embodying interface node extensions from the interface node to the support truss.

FIG. 23 shows an embodiment of the interface node (600) that incorporates interface node extensions (650). In the case when the interface node (600) is a circular cylinder shape, the support truss (400) to interface node (600) connection can be difficult to fabricate. In this case using the interface node extension (650) allows for easier structural interface fabrication of the support truss (400) to the interface node (600) connection through the interface node extension (650).

Another advantage of using a node interface extension (650) is that it provides additional deck area for access, equipment and systems.

Figure 24:
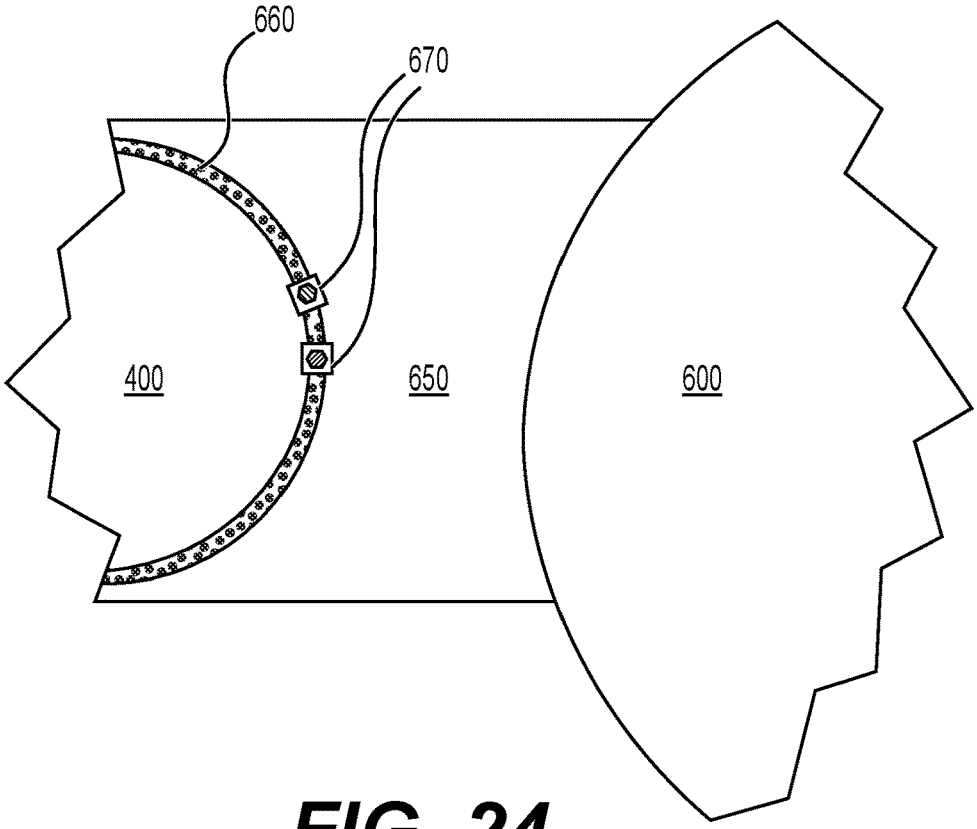
FIG. 24 is a plan view of a section of the support truss connected to the interface node via an interface node extension with vertical bolts.
Figure 25:
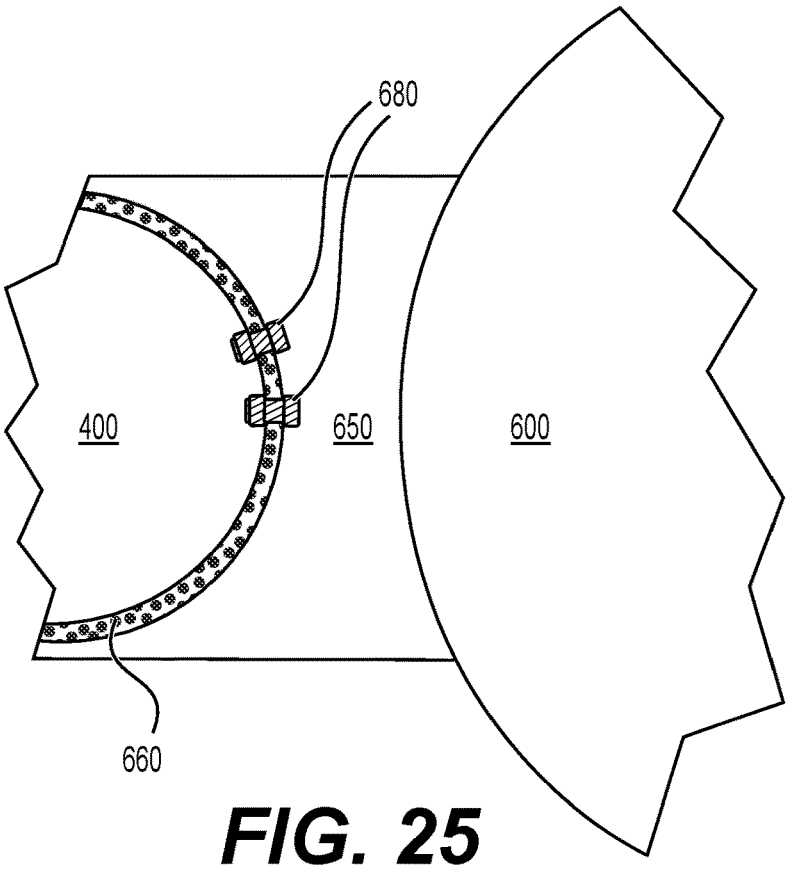
FIG. 25 is a plan view of a section of the support truss connected to the interface node via an interface node extension with horizontal bolts.

FIGS. 24 and 25 illustrate a method of connecting the support truss (400) to the interface node extension (650) in which the support truss (400) is inserted into the interface node extension (650) and then bolted either vertically (670) or horizontally (680). In between the support truss (400) and interface extension node (650), grouting (660) or other polymer adhesives may be used to provide additional connection strength. Welding may also be used to connect the support truss (400) to the interface node extension (650).

Figure 26:
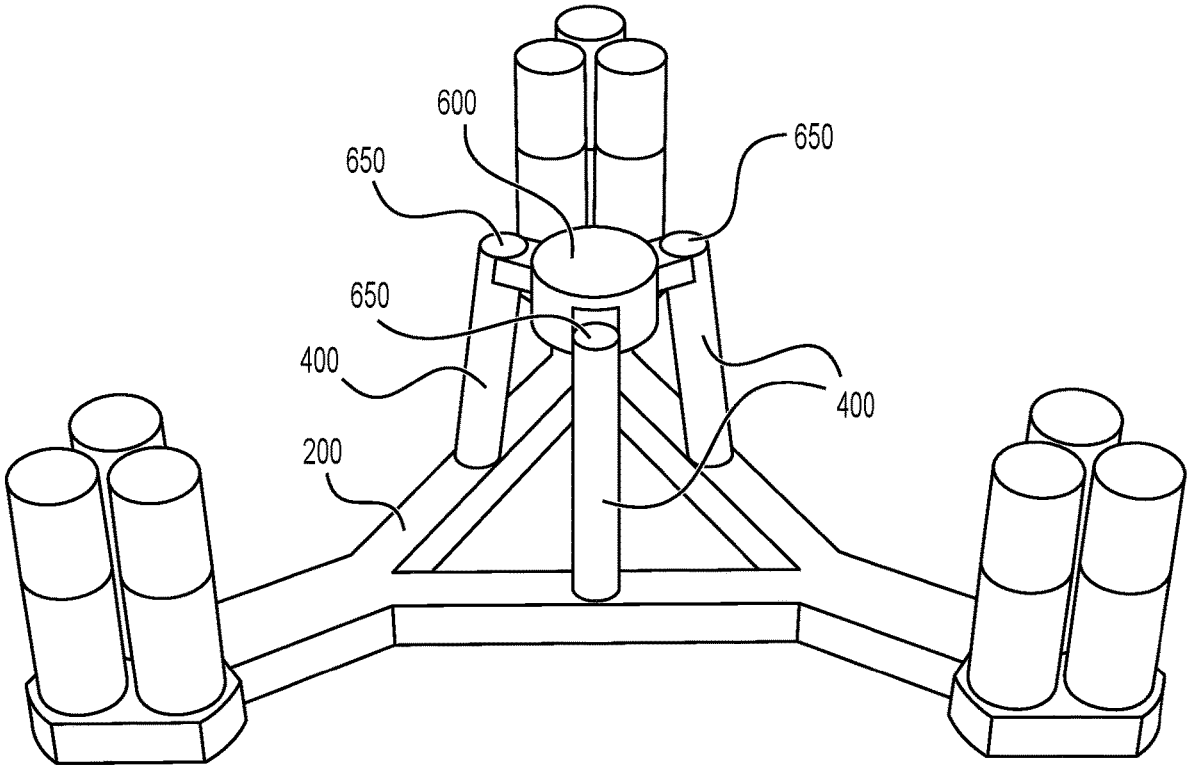
FIG. 26 is a perspective view of an embodiment of the support truss arranged on the central pontoon.

An additional embodiment of the foundation design is illustrated in FIG. 26. In this configuration, the support truss (400) is connected to the central pontoon (200). This embodiment increases the length of the central pontoon (200) and reduces the length of the outer pontoons (150) which decreases the bending moments on the outer pontoons (150) improving the structural efficiency of the outer pontoons (150).

The embodiment shown in FIG. 26 also results in smaller support truss (400) span on the central pontoon (200) compared to the orientation shown in FIG. 23. The smaller span allows for easier lift and set of the support truss (400) onto the central pontoon (200) and allows for smaller transport vessels for the support truss (400) to be used.

In addition, the embodiment shown in FIG. 26 will increase the support truss angle (452) and shorten the support truss length (400) resulting in reduced bending loads.

INDUSTRIAL APPLICABILITY

The embodiments of the present disclosure may be used in the industry of offshore platforms which support wind power generation systems or the like.

The invention claimed is:

1. A floating offshore foundation including a plurality of unit modules capable of being connected to each other, the floating offshore foundation comprising:

a central pontoon module;

a plurality of outer pontoon modules configured to have one end thereof connected to the central pontoon module;

a plurality of outer node modules, each of the outer node module configured to connect to an other end of a corresponding outer pontoon module of the plurality of outer pontoon modules;

a support truss module disposed above the central pontoon module and comprising a plurality of legs, each of the plurality of legs configured to connect to an upper side of a corresponding outer pontoon module; and a plurality of outer column modules, wherein each of the plurality of outer column modules are reconfigurable and are disposed on an upper side of a corresponding outer node module of the plurality of outer node modules, and wherein the plurality of unit modules are configured to detachably connect to each other.

2. The floating offshore foundation of claim 1, wherein each of the outer column modules comprises a plurality of columns.

3. The floating offshore foundation of claim 2, wherein each of the plurality of the columns comprises a plurality of sub-module columns, and the each of the plurality of the sub-module columns are configured to connect to and disconnect from each other.

4. The floating offshore foundation of claim 3, wherein at least one of the plurality of sub-module columns has a different shape or dimension or is made of a different material.

5. The floating offshore foundation of claim 3, wherein at least one of the plurality of the sub-module columns comprises a central connector for fixing the plurality of the sub-module columns.

6. The floating offshore foundation of claim 1, wherein the plurality of unit modules are configured to connect to each other by a mechanical means.

7. The floating offshore foundation of claim 6, wherein the mechanical means for connecting the plurality of unit modules is one or more means selected from the group consisting of stabbing structures with locking pins, structural plates/tubulars, flanges, arrayed interlocking joints, receptacles and tab locking structures, ultra-high performance concrete, pin and hinge connection, and pin and box connection.

8. The floating offshore foundation of claim 1, further comprising an internal endo-structural system connecting the plurality of outer pontoon modules to the central pontoon module, the outer pontoon modules to the outer node modules, and/or the support truss module to the outer pontoon modules.

9. The floating offshore foundation of claim 8, wherein the internal endo-structural system comprises a plurality of structural members disposed within the unit modules.

10. The floating offshore foundation of claim 9, wherein the structural members of the internal endo-structural system protrude from a male unit module which connect to a respective female unit module.

11. The floating offshore foundation of claim 9, wherein the structural members are made of steel and a surrounding material is made of a material lighter than steel.

12. The floating offshore foundation of claim 1, further comprising an interface node module configured to support an offshore energy system there above and to connect to an upper side of the support truss module.

13. The floating offshore foundation of claim 12, wherein the interface node module comprises a structural component for connecting to the support truss module and a connection component configured to support the offshore energy system, wherein the connection component is replaceable to accommodate different types and sizes of offshore energy systems.

14. The floating offshore foundation of claim 1, wherein the legs of the support truss module are connected to the corresponding outer pontoon module at a connection angle between 45 and 60 degrees.

15. The floating offshore foundation of claim 1, wherein an end of the legs of the support truss module are connected via a hinge and pin connection component disposed on the upper side of the outer pontoon modules.

16. A method of assembling a modular floating offshore foundation, the method comprising:

manufacturing a plurality of unit modules of the modular floating offshore foundation; and connecting the plurality of units modules, wherein the plurality of unit modules comprises:

a central pontoon module;

a plurality of outer pontoon modules configured to have one end thereof connected to the central pontoon module;

a plurality of outer node modules, each of the outer node module configured to connect to an other end of a corresponding outer pontoon module of the plurality of outer pontoon modules;

a support truss module disposed above the central pontoon module and comprising a plurality of legs, each of the plurality of legs configured to connect to an upper side of a corresponding outer pontoon module; and a plurality of outer column modules, wherein each of the plurality of outer column modules are reconfigurable and are disposed on an upper side of a corresponding outer node module of the plurality of outer node modules, wherein the plurality of unit modules are configured to detachably connect to each other, and wherein each of the outer column modules comprises a plurality of columns.

17. The method of claim 16, wherein the connecting the plurality of unit modules is performed on waters, and wherein the plurality of unit modules comprises a ballast system for controlling module draft during and after assembly.

18. The method of claim 17, wherein a connection support caisson is used between at least some of the plurality of unit modules to facilitate floating connection.

19. The method of claim 16, wherein the connecting the plurality of unit modules is performed on waters using a plurality of barges to support floating of the plurality of unit modules.

20. The method of claim 16, wherein the connecting the plurality of unit modules is performed by mechanical means, and wherein the mechanical means for connecting the plurality of unit modules is one or means selected from the group consisting of stabbing structures with locking pins, structural plates/tubulars, flanges, arrayed interlocking joints, receptacles and tab locking structures, ultra-high performance concrete, pin and hinge connection, and pin and box connection.

21. The method of claim 16, wherein a plurality of interface node extensions are used to connect a plurality of support trusses and the interface node.

22. The method of claim 16, wherein the support truss can be connected to the central pontoon.

* * * * *